United States Patent [19]

Johnstone et al.

[11] Patent Number: 4,470,877

[45] **Date of Patent: * Sep. 11, 1984**

[54] PAPER HAVING CALCIUM SULFATE MINERAL FILLER FOR USE IN THE PRODUCTION OF GYPSUM WALLBOARD

[75] Inventors: Norman E. Johnstone; John R. Kehoe, both of Schaumburg, Ill.

[73] Assignee: United States Gypsum Company, Chicago, Ill.

[ * ] Notice: The portion of the term of this patent subsequent to Feb. 8, 2000 has been disclaimed.

[21] Appl. No.: 462,629

[22] Filed: Jan. 31, 1983

Related U.S. Application Data

[63] Continuation-in-part of Ser. No. 263,371, May 13, 1981, Pat. No. 4,372,814, and a continuation-in-part of Ser. No. 441,711, Nov. 15, 1982, , which is a continuation-in-part of Ser. No. 263,371.

[51] Int. Cl.[3] ..... B32B 13/08

[52] U.S. Cl. ..... 162/124; 156/39; 156/41; 162/128; 162/135; 162/158; 162/168.1; 162/168.2; 162/168.3; 162/169; 162/181.1; 162/181.2; 162/181.3; 162/183; 428/537.7; 428/703

[58] Field of Search ..... 162/124, 128, 135, 158, 162/183, 184, 168.1, 168.2, 168.3, 169, 181.1, 181.2, 181.3; 156/39, 41, 44; 428/537, 703

[56] References Cited

U.S. PATENT DOCUMENTS

| | | | |
|---|---|---|---|
| 3,102,064 | 8/1963 | Wurzburg et al. | 162/158 |
| 3,300,371 | 1/1967 | Hart | 162/128 |
| 4,064,317 | 12/1977 | Fukuba et al. | 428/537 |
| 4,204,030 | 5/1980 | Takamizawa et al. | 428/703 |
| 4,311,767 | 1/1982 | Kennedy | 428/537 |

*Primary Examiner*—Peter Chin

*Attorney, Agent, or Firm*—Samuel Kurlandsky; Robert H. Robinson; Robert M. Didrick

[57] ABSTRACT

A composite paper particularly adapted for use as cover sheets in the production of gypsum wallboard, the paper being sufficiently porous to permit better drainage and more rapid drying in the production of the paper, and when applied to the surfaces of a gypsum slurry for forming wallboard, permits less heat to be utilized in the wallboard conversion, thereby saving energy in the board production required for drying the board. The paper comprises in weight percent:

(A) cellulosic fibers in an amount of from about 65% to about 90% and preferably having a fiber freeness of from about 300 ml to about 550 ml Canadian Standard Freeness, (B) calcium sulfate as a filler in an amount of from about 10% to about 35%, (C) a binder in an amount from about 1% to about 3½%, (D) a flocculant in an amount of from about 0.1% to about 0.2%, (E) a buffering agent in an amount from about 0.25% to about 10%, (F) a neutral sizing agent in an effective amount to prevent water penetration, (G) an anionic polymer in an amount suitable for retaining said filler in said paper, and (H) a cationic starch when a succinic anhydride is used as the neutral sizing agent.

In a preferred embodiment, after the paper is treated with a neutral internal sizing agent during its formation, it is subsequently treated with a surface sizing agent after formation of the paper, in order to provide certain properties including better adhesion to the gypsum core when used to make gypsum wallboard.

28 Claims, No Drawings

PAPER HAVING CALCIUM SULFATE MINERAL FILLER FOR USE IN THE PRODUCTION OF GYPSUM WALLBOARD

RELATED APPLICATIONS

This application is a continuation-in-part of copending applications U.S. Ser. No. 263,371 filed May 13, 1981 now U.S. Pat. No. 4,372,814, and U.S. Ser. No. 441,711 filed Nov. 15, 1982, which is in turn a continuation-in-part of U.S. Ser. No. 263,371 by the present inventors.

BACKGROUND OF THE INVENTION

1. Field of the Invention

The present invention relates to paper-making, and more particularly refers to the production of a calcium sulfate-filled and neutral sized paper particularly well adapted for use as cover sheets in the production of gypsum wallboard.

2. Description of the Prior Art

Paper for gypsum board is conventionally made by pulping up waste paper constituents of old corrugated paper, or kraft cuttings and waste news. In cleaning, screening and refining the suspended materials in water suspension, the process paper stock is diluted still further with water and then formed by draining the plies of paper on several continuously moving wire cylinders, where the separate plies are joined together by a carrying felt. The weak paper web is then dewatered in a press section where water is pressed out of the web. The pressed paper is dried in a multi-cylinder drying section with steam added to each cylinder. The dried paper is subjected to a squeezing or calendaring operation for uniformity in thickness and is then finally wound into rolls. The paper is subsequently utilized as paper cover sheets to form gypsum wallboard by depositing a calcined gypsum slurry between two sheets, and permitting the gypsum to set and dry.

Conventional paper used in gypsum wallboard has definite limitations with regard to the utilization of heat energy. First, it has definite drainage limitations in forming and pressing, and additional limitations in the drying rate. The drainage rate limitations impose a large paper drying energy load on the mill. It would be highly desirable to have a more porous paper for utilization as paper cover sheets in the formation of gypsum wallboard to permit the achievement of a substantial reduction in drying energy load, while still having a paper which has the requisite physical properties with regard to physical strength even though less pulp is utilized.

SUMMARY OF THE INVENTION

It is accordingly an object of the invention to provide paper for use as paper cover sheets in the production of gypsum wallboard.

It is another object of the invention to provide paper for use in making gypsum wallboard which is highly porous and requires less energy for drying than conventional paper previously utilized for this purpose.

It is still another object to provide a paper of the type described which has sufficiently high tensile strength for use in gypsum wallboard.

It is still a further object to provide a porous paper for making gypsum wallboard which is so treated that excellent adhesion is obtained between the paper cover sheet and the gypsum core even though the paper has a greater porosity than that found in conventional paper.

Other objects and advantages of the invention will become apparent upon reference to the description below.

According to the invention, a paper eminently suitable for use in fabricating gypsum wallboard is produced using substantially conventional paper processes, and having the following composition (dry weight basis):

(A) cellulosic fibers in an amount of from about 65% to about 90% and preferably having a fiber freeness of from about 300 ml to about 550 ml Canadian Standard Freeness, (B) calcium sulfate as a filler in an amount of from about 10% to about 35%, (C) a binder in an amount from about 1% to about 3½%, (D) a flocculant in an amount of from about 0.1% to about 0.2%

(E) a buffering agent in an amount from about 0.25% to about 10%, (F) a neutral sizing agent in an effective amount to prevent water penetration, (G) an anionic polymer in an amount suitable for retaining said filler in said paper, and (H) a cationic starch when a succinic anhydride is used as the neutral sizing agent.

In a preferred embodiment, after the paper is treated with a neutral internal sizing agent during its formation, it is subsequently treated with a surface sizing agent after formation of the paper, in order to provide certain properties including better adhesion to the gypsum core when used to make gypsum wallboard.

During the paper-making process, rapid drying is obtained with less than the normal amount of heat energy required. The finished paper has excellent porosity, tensile strength and fire resistant properties. Further, when the paper is utilized as paper cover sheets in the manufacture of gypsum wallboard, the porosity of the paper facilitates the drying and setting of finished wallboard.

The paper may be utilized as paper cover sheets for the production of gypsum wallboard. In the setting and drying of the wallboard, because of the excellent porosity of the paper, less energy need be utilized and more rapid drying is obtained, to produce a wallboard wherein the paper has excellent tensile strength and fire resistant properties. In a preferred embodiment the paper is treated with an internal sizing agent during its formation, and subsequently treated with a surface sizing agent after formation, in order to provide better adhesion to the gypsum core.

DESCRIPTION OF THE PREFERRED EMBODIMENTS

In the examples which follow the paper was prepared by the method of Procedure A which follows:

PROCEDURE A

An aqueous slurry was prepared comprising 20 oven dry grams of fiber and 3500 ml of water. The slurry was subjected to stirring with a three bladed propeller at 200 RPM. During the agitation, the designated amount of $CaSO_4$ land-plaster filler in amounts of from 10–30% were added dry to the slurry. After three minutes of agitation, 4 lb/ton of the designated flocculant were added in a solution containing 0.1% solids. After agitation was carried out for an additional three minutes, the designated amount of binder in amounts from about 0.5% to 3% were added at a total solids content from about 3% to 50%. Stirring or agitation was continued at 1250 RPM for an additional three minutes after which time the slurry was diluted to a consistency of 0.3% total solids content. A sufficient amount of the slurry was then added to a standard 6¼" (159 mm) diameter sheet mold. Size emulsion in designated amounts was added to the sheet mold contents which were subsequently agitated. After agitation, the anionic polymer retention aid was added to the sheet mold in designated amounts followed by agitation. A 1.50 gram handsheet was subsequently formed in the sheet mold. The drainage time was recorded and the wet sheet was couched off the 150 mesh sheet mold screen.

Handsheets were stacked while still wet on blotters and then covered with a mirror polished disc. The handsheets were then pressed at 50 pounds/square inch for five and one half minutes. At this point the wet blotters were removed and the handsheets were inverted so that the metal plate was on the bottom. Dry blotters were utilized to replace the wet ones and the stack was pressed at the same pressure for two and one-half minutes. The partially dry handsheets were peeled off the metal plates and dried on a rotating drum dryer for one pass which took approximately 40 seconds. At the end of this period the handsheets were dry.

The dried handsheets were then coated with 0.35 lb/ton of a silicone surface sizing agent and then redried for 20 seconds in the handsheet dryer. Afterwards the handsheets were oven-cured at 140° F. for 24 Hrs. and then allowed to come to equilibrium at room conditions for 1 hour before testing.

Additionally, in the examples which follow, where gypsum board was prepared from the papers which were fabricated and described in the tables, the gypsum wallboard was prepared from the papers utilizing the method of Procedure B which follows:

PROCEDURE B

Production of Gypsum Wallboard

Gypsum wallboard was produced by discharging a stucco slurry from a mixer onto prepared paper with the topliner face downward while the paper was moving continuously. A top sheet, which is newslined, was brought into contact with the upper surface of the slurry, and subsequently the combination of facing papers and slurry was passed under a forming roll to distribute the slurry uniformly and to form the board into a uniform cross-section. The edges of the paper were folded up and over the edges of the top paper, and the edges of the board were formed in the same operation.

The wet gypsum board was carried through the forming section of the board machine on a continuously moving belt until the board core was fully hydrated to calcium sulfate dihydrate. Subsequently, the board was conveyed onto continuously moving strip belt conveyors to the knife section where the board was cut into conventionally desired lengths.

The board was then inverted with the manila face up and fed into a drying kiln on continuously turning rollers, where it was dried to a uniform 5–6% moisture content. The board was inspected and then stacked into packages.

Testing of Gypsum Wallboard

Before gypsum wallboard is marketed it is first subjected to specific quality control tests to ascertain that the board meets quality standards. Among the various tests which are generally conducted were ASTM nail pull and transverse strengths. Also tested are humidified bond for both face and backsides of the board, face Cobbs and total immersion absorption water resistance tests on board to be used for high humidity application and/or sheathing board, and face absorption water absorptiveness tests on board for plaster application.

The nail pull test consists of applying an ever-increasing amount of weight on a specially designed nail until the head is pulled through the board sample. Weight at failure is recorded.

Transverse strength tests are carried out by applying a force downwardly in the center of the specimen which is supported at two opposing outer edges. The face which is positioned downwardly is the face which is tested. Force applied at failure is the measurement of transverse strength.

The humidified bond test consists of humidifying the board for three hours at 90% relative humidity and 90° F. temperature, and then applying a force on the board sufficient to break the bond between the paper and the board core. The applied force or weight at failure is the measure of bond strength.

Face Cobb and absorption tests are carried out by conventional methods.

The total immersion water absorption tests are conducted by immersing a 12 inch by 12 inch sample of board for two hours in 70° F. temperature water. The weight of water absorbed is determined by difference and converted to percent absorption based on dry weight.

In copending application U.S. Ser. No. 263,371, filed May 13, 1981 referred to above, results were given of tests made utilizing calcium sulfate as a mineral filler for paper to be used in making gypsum wallboard. The results of those experiments were not entirely satisfactory since insufficient calcium sulfate was retained in the paper when used with the retention aids disclosed therein. It has been subsequently found that excellent retention of calcium sulfate as a mineral filler may be accomplished by the use of an anionic polyacrylamide retention aid when added to the dilute furnish used when making the paper. When this anionic polyacrylamide polymer was added, the filler retention was vastly improved and the handsheets strengths were also improved.

In Examples 1–17 below are results for various handsheets containing various proportions of calcium sulfate landplaster ($CaSO_4.2H_2O$) as a filler together with varying amounts of an anionic polymer utilized as the retention aid. The handsheets were all prepared according to Procedure A. The compositions and the results of conventional paper tests are shown in Table I below. Since the experiments were designed primarily to test the effect of the anionic polymer as a retention aid, convention ingredients normally used in making paper suitable for use in making gypsum wallboard were not incorporated.

Further, the white water from a given handsheet was recirculated to make the subsequently formed handsheets.

TABLE I

CALCIUM SULFATE - LANDPLASTER AS A GYPSUM BOARD PAPER FILLER, NO INTERNAL NOR SURFACE SIZES APPLIED

| Example Number | No. of Handsheets and Recircu-lations | % $CaSO_4$ Added to Sheet | (1) % Latex Added to Sheet | (2) Cationic Floccu-lant Addition Rate, lb/ton | (3) Anionic Polymer Ret. Aid Addition Rate, lb/ton | Zeta Potential, MV | % Ash As $CaSO_4.2H_2O$ (Dihydrate) | $Ca^{++}$ ion Concen-tration, ppm | Basis Weight lb/1000 $ft^2$ |
|---|---|---|---|---|---|---|---|---|---|
| 1 | 5 | 27 | 3 | 4 | 0 | −12.4 | 18.6 | 70 | 14.7 |
| 2 | 10 | 27 | 3 | 4 | 0 | −13.0 | 16.0 | 80 | 14.6 |
| 3 | 15 | 27 | 3 | 4 | 0 | −12.7 | 14.4 | 99 | 14.5 |
| 4 | 20 | 27 | 3 | 4 | 0.75 | −14.4 | 22.5 | 94 | 15.4 |
| 5 | 25 | 27 | 3 | 4 | 1.50 | −13.0 | 27.6 | 94 | 16.1 |
| 6 | 30 | 27 | 3 | 4 | (4) 0.75 | −12.4 | 23.3 | 89 | 15.2 |
| 7 | 35 | 27 | 3 | 4 | (4) 1.50 | −12.7 | 20.4 | 84 | 16.4 |
| 8 | 5 | 20 | 2 | 4 | 0 | −5.2 | 15.0 | 41 | 15.2 |
| 9 | 10 | 20 | 2 | 4 | 0 | −6.2 | 16.9 | 45 | 17.4 |
| 10 | 15 | 20 | 2 | 4 | 0 | −5.5 | 12.0 | 42 | 17.1 |
| 11 | 20 | 20 | 2 | 4 | 0.75 | −5.5 | 18.2 | 44 | 14.4 |
| 12 | 25 | 20 | 2 | 4 | 1.50 | −6.6 | 19.2 | 50 | 17.2 |
| 13 | 5 | 10 | 1 | 4 | 0 | −4.9 | 6.8 | 44 | 19.5 |
| 14 | 10 | 10 | 1 | 4 | 0 | −5.8 | 6.9 | 46 | 18.4 |
| 15 | 15 | 10 | 1 | 4 | 0 | −5.4 | 6.4 | 48 | 17.5 |
| 16 | 20 | 10 | 1 | 4 | 0.75 | −4.7 | 9.4 | 46 | 17.6 |
| 17 | 25 | 10 | 1 | 4 | 1.50 | −4.8 | 7.4 | 49 | 17.2 |

| Example Number | Porosity Seconds | Breaking Meters | Tear Factor | Burst Factor |
|---|---|---|---|---|
| 1 | 52.1 | 5208 | 20.3 | 863 |
| 2 | 67.4 | 5208 | 20.0 | 769 |
| 3 | 23.9 | 5033 | 20.5 | 869 |
| 4 | 32.1 | 5224 | 20.3 | 881 |
| 5 | 21.7 | 4934 | 20.8 | 819 |
| 6 | 24.0 | 4822 | 21.9 | 877 |
| 7 | 24.4 | 4489 | 22.1 | 890 |
| 8 | 11.2 | 4338 | 22.5 | 697 |
| 9 | 16.2 | 3967 | 23.3 | 672 |
| 10 | 34.0 | 4271 | 15.1 | 751 |
| 11 | 6.2 | 3686 | 12.5 | 572 |
| 12 | 28.0 | 3931 | 15.9 | 588 |
| 13 | 38.6 | 4330 | 19.9 | 828 |
| 14 | 30.8 | 5050 | 22.9 | 842 |
| 15 | 36.6 | 3949 | 18.2 | 823 |
| 16 | 45.4 | 4215 | 15.5 | 799 |
| 17 | 32.0 | 4190 | 18.6 | 674 |

(1) Carboxylated Styrene - Butadiene Latex with S/B ratio of 50/50, Dow XD - 30374.02 Anionic Latex.
(2) Low Molecular Weight, Moderate Charge Density Cationic Polyacrylamide (Quarternary Amine), Dow XD - 30440.01 Cationic Flocculant.
(3) High Molecular Weight, High Charge Density Anionic Polyacrylamide (Hydrated), Dow XD - 30057.03 Anionic Polymer.
(4) Effect of H.M.W., M.C.D. Cationic Retention Aid on System. Cationic Polyacrylamide (Quarternary Amine) Dow XDR - 1855-26-P967.

From the results shown above, it is evident that as the number of recirculations increases $Ca^{++}$ ion concentration builds up, retention of the landplaster deteriorates without the admixture of the anionic polymer retention aid. This is true for every level of landplaster evaluated. This constituted 27% in Examples 1–7, 20% in Examples 8–12, and 10% in Examples 13–17. The results of Examples 6 and 7, where a cationic polymer instead of an anionic polymer was used clearly illustrate the deterioration in both filler retention by percent and breaking length with the admixture of the cationic polymer. These results clearly show the need for the use of an anionic polymer for proper landplaster retention in a system that is highly anionic as indicated by the negative Zeta potential.

In Examples 18–27 below paper handsheets utilizing calcium sulfate dihydrate as a filler, an anionic polymer as a retention aid and a ketone dimer as an internal sizing agent were prepared according to the method of Procedure A above. The compositions utilized in Examples 18–27 and the conventional tests results are shown below below in Table II:

TABLE II

KETENE DIMER AS(1) INTERNAL SIZING AGENT FOR $CaSO_4$ (5)FILLED GYPSUM BOARD PAPER

| Example Description | Example Number | Paper Tests: Basis Weight lb/1000 $ft^2$ | Paper Tests: % $CaSO_4$ as Land-plaster | Paper Tests: Cobb Water Resistance, Grams | Paper Tests: Saturation Water Resistance, Minutes | Board Tests (Humidified Bond Test Results): Bond Failure, Percent | Board Tests (Humidified Bond Test Results): Bond Strength, Lb (Force) |
|---|---|---|---|---|---|---|---|
| No Retention Aid | | | | | | | |
| With Silicone(4) | 18 | 54.05 | 14.9 | 0.60 | 120+ | 0.0 | 14.3 |
| Without Silicone | 19 | 67.70 | 13.4 | 0.61 | 120+ | 0.0 | 7.5 |

TABLE II-continued

KETENE DIMER AS[1] INTERNAL SIZING AGENT FOR $CaSO_4$ [5]FILLED GYPSUM BOARD PAPER

| Example Description | Example Number | Paper Tests: Basis Weight lb/1000 ft² | Paper Tests: % $CaSO_4$ as Land-plaster | Paper Tests: Cobb Water Resistance, Grams | Paper Tests: Saturation Water Resistance, Minutes | Board Tests (Humidified Bond Test Results): Bond Failure, Percent | Board Tests (Humidified Bond Test Results): Bond Strength, Lb (Force) |
|---|---|---|---|---|---|---|---|
| Anionic Retention Aid[2] | | | | | | | |
| 0.75 lb/ton Retention Aid | | | | | | | |
| With Silicone[4] | 20 | 51.87 | 15.1 | 0.55 | 120+ | 7.8 | 13.8 |
| Without Silicone | 21 | 46.14 | 14.5 | 0.63 | 120+ | 78.5 | 9.0 |
| 1.50 lb/ton Retention Aid | | | | | | | |
| With Silicone[4] | 22 | 50.97 | 20.9 | 0.54 | 120+ | 13.2 | 14.2 |
| Without Silicone | 23 | 50.02 | 20.1 | 0.62 | 120+ | 18.1 | 11.0 |
| Cationic Retention Aid[3] | | | | | | | |
| 0.75 lb/ton Retention Aid | | | | | | | |
| With Silicone[4] | 24 | 53.0 | 22.2 | 0.47 | 120+ | 2.3 | 14.8 |
| Without Silicone | 25 | 46.2 | 18.9 | 0.54 | 120+ | 18.5 | 12.0 |
| 1.50 lb/ton Retention Aid | | | | | | | |
| With Silicone[4] | 26 | 45.9 | 16.7 | 0.51 | 120+ | 32.2 | 14.4 |
| Without Silicone | 27 | 47.7 | 19.3 | 0.57 | 120+ | 34.5 | 14.3 |

[1]5 lb/ton of size as Hercon 32
[2]Solid form of Dow XD - 30057.03 HMW, HCD Anionic Polyacrylamide
[3]Dow EO retention aid
[4]0.35 lb/ton of Goldschmidt 5342 Silicone
[5]30% $CaSO_4$ as Landplaster, 3% Latex, S/B, C; 4 lb/ton Cationic Flocculant The results of the experiments of Examples 18–27 above and shown in Table II indicate the suitability of a ketene dimer as an internal size for calcium sulfate dihydrate (landplaster) filled gypsum board paper. The results shown in the table are based on tests conducted on handsheets prepared by the method of Procedure A except that saturated calcium sulfate water was used in making up the furnish and in diluting the furnish in a large 12"×12" sheet mold where heavier basis weight handsheets were produced than those produced by the basic method of Procedure A. The data shown above in Table II indicate that where a proprietary ketene dimer size such as HERCON 32 marketed by the Hercules Company, is used either with an anionic or a cationic polymer retention aid, it provides improved landplaster retention in the presence of calcium ions. The paper sizing tests indicate that the HERCON 32 ketene dimer size provided excellent sizing results regardless of the charge of the retention aid and with or without silicone surface size application. The board test data also shown above in Table II demonstrate that with few exceptions the ketene dimer internally sized paper, when additionally surface sized with a silicone polymer, provides good bond to gypsum board. The desirability of the use of the silicone surface size is indicated by the generally lower bond failures and higher bond strength which were obtained when the silicone size was applied, compared to the handsheets where it was not applied.

The ketene dimer has the following structural formula:

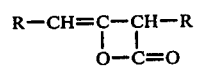

wherein the two radicals, R, each may have 8–18 carbon atoms, and the indicated ring is a lactone ring.

Conventionally, the ketene dimers are formed from a 50/50 mixture of palmitic and stearic fatty acids, although they may be formed from any fatty acids with 10 to 20 carbon atoms. The ketene dimers are usually emulsified in a cationic starch solution in the ratio of 3 or 4 parts of dimer to 1 part of cationic starch. Proprietary ketene dimers usually contain a cationic polymer which acts as a size retention aid in the paper machine furnish.

Succinic Acid Anhydride as an Internal Sizing Agent for $CaSO_4$-Filled Gypsum Board Paper In Examples 28–30 succinic acid anhydride internal size was utilized in preparing a calcium sulfate-filled gypsum board paper, utilizing an anionic polymer as a retention aid. Additionally a silicone polymer size acidified with 1% alum solids was applied as a surface size to the dried paper. The formulations of Examples 28–30 and tests results of the prepared paper, as well as gypsum board samples prepared from the papers as shown below in Table III. Additionally tests results of the paper and of the prepared gypsum board are shown.

TABLE III

SUCCINIC ACID ANHYDRIDE AS INTERNAL SIZING AGENT FOR $CaSO_4$ FILLED GYPSUM BOARD PAPER*

| Example Description | Example Number | Paper Test: **Anionic Polymer Rate, lb/ton | Paper Test: Cobb Water Resistance, Grams | Paper Test: Saturation Water Resistance, Minutes | Board Tests Humidified Bond Test Results (Conditioned for 3 hrs at 90° F./90% RH): Bond Failure, Percent | Board Tests Humidified Bond Test Results (Conditioned for 3 hrs at 90° F./90% RH): Bond Strength, lb (Force) |
|---|---|---|---|---|---|---|
| 55 lb/1000 ft² Basis Weight Handsheets Sized Internally with 5 lb/ton of ACCOSIZE 18 | 28 | 0.0 | 0.63 | 120+ | 38.9 | 9.0 |

TABLE III-continued

SUCCINIC ACID ANHYDRIDE AS INTERNAL SIZING AGENT FOR $CaSO_4$ FILLED GYPSUM BOARD PAPER*

| Example Description | Example Number | Paper Test: **Anionic Polymer Rate, lb/ton | Paper Test: Cobb Water Resistance, Grams | Paper Test: Saturation Water Resistance, Minutes | Board Tests Humidified Bond Test Results (Conditioned for 3 hrs at 90° F./90% RH): Bond Failure, Percent | Board Tests Humidified Bond Test Results (Conditioned for 3 hrs at 90° F./90% RH): Bond Strength, lb (Force) |
|---|---|---|---|---|---|---|
| and 10 lb/ton of STA-LOK 500. | | | | | | |
| Anionic Polymer added to Furnish after Size at Rates Indicated. | 29 | 0.75 | 0.58 | 120+ | 19.4 | 17.0 |
| 0.35 lb/ton of Acidified RE-30 Silicone Applied to Surface of Paper After Drying. | 30 | 1.50 | 0.55 | 120+ | 0.0 | 16.0 |

*Paper Composition: 30% $CaSO_4$ as Landplaster, 3% Dow Styrene/Butadiene Carboxylated Latex, 4 lb/ton of Dow Cationic Flocculant.
**Anionic Polymer is Dow XD 30057.03, High Molecular Weight, Medium Charge Density Anionic Polyacrylamide Produced from Acrylic Acid Hydrated Polyacrylamide.

The data obtained from testing the samples of Examples 28–30 show that at all levels of anionic polymer application, paper sizing by the combination of internal size and silicone resin surface sizes produced excellent paper. The tests made on the finished gypsum wallboard show that the anionic polymer is particularly useful in providing a sheet which demonstrates superior bond to the gypsum board to which it is applied. This is shown by the decreasing bond failure and the increasing bond strength with increasing anionic polymer addition. The handsheets prepared and illustrated in Table III were prepared in a method similar to that of Procedure A but with a large 12"×12" sheet mold to produce 12"×12" 55 lb/1000 $ft^2$ basis weight handsheets.

The internal size utilized was ACCOSIZE 18, a trademarked product marketed by American Cyanamid which contains 1% anionic surfactant as an emulsifying agent, and which was emulsified in a turbine emulsifier with 3% cationic potato starch as the emulsifying medium. Two pounds of starch were used with each pound of sizing material.

In Examples 31 and 32 a ketene dimer was compared to succinic acid anhydride as an internal size for calcium carbonate-filled gypsum board paper. The handsheets of these examples were prepared in a manner similar to that of Procedure A, except that the large 12"×12" sheet mold was used to make 12"×12" handsheets of 55 lb/1000 $ft^2$ basis weight and a cationic in place of an anionic retention aid was used. The formulations and results are shown below Table IV.

TABLE IV

ALTERNATE SIZE, BINDER AND RETENTION AID FOR $CaCO_3$ FILLED PAPER FOR GYPSUM BOARD

Ketene Dimer as Internal Size for $CaCO_3$ - Filled Gypsum Board Paper,
(1)0.5 lb/ton of Cationic Retention Aid Added to Furnish, No Surface Size Applied to Dry Paper Surface
Example Description:
55 lb/1000 $ft^2$ basis weight handsheets, made with 80% kraft, 20% news fiber furnish, 27% $CaCO_3$, 3% Dow Carboxylated styrene-butadiene latex, and 4 lb/ton of Dow Cationic Flocculant XD - 30440.01.

| | Example Number | Paper Tests: Cobb Water Resistance, Grams | Paper Tests: Saturation Water Resistance, Minutes | Board Tests (Conditioned for 3 Hrs at 90° F./90% RH): Bond Failure, Percent: Avg. | Bond Failure, Percent: High Value | Bond Failure, Percent: Low Value | Bond Strength Lb (Force): Avg. | Bond Strength Lb (Force): High Value | Bond Strength Lb (Force): Low Value |
|---|---|---|---|---|---|---|---|---|---|
| CONTROL | | | | | | | | | |
| 10 lb/ton Fibran 68(2) Internal Size with 15 lb/ton of STA-LOK 500 | 31 | 0.66 | 20 | 21.4 | 50.0 | 0 | 9.0 | 13 | 7 |
| KETENE DIMER | | | | | | | | | |
| 5 lb/ton of Hercon 40 No additional cationic starch. | 32 | 0.56 | 120+ | 18.4 | 21.5 | 16.7 | 9.0 | 11 | 8 |

(1)High Molecular Weight, Medium Charge Density Cationic Polyacrylamide.
(2)Succinic Acid Anhydride Sizing Agent Made by National Starch and Chemical Company and Combined with 1 Part of Non-ionic Surfactant Emulsifying Agent to 17 parts of Size.

STA-LOK 500 Cationic Potato Starch as Binder and
(1)Anionic Polymer as Retention Aid in $CaCO_3$ - Filled Gypsum Board Paper(2)
Example Description:
80% old corrugated and 20% waste news refined to 350 ml. CSF.

| Example Number | Anionic Polymer Rate, lb/ton | Filler Addition Rate, Percent | Binder Addition Rate, Percent | Basis Weight lb/1000 $ft^2$ | $CaCO_3$ Retention in Sheet, Percent | 1st. Pass Retention Percent | Sheet Porosity Seconds | (3) Sheet Tensile Strength |
|---|---|---|---|---|---|---|---|---|

TABLE IV-continued

ALTERNATE SIZE, BINDER AND RETENTION AID FOR $CaCO_3$ FILLED PAPER FOR GYPSUM BOARD

| | | | | | | | | |
|---|---|---|---|---|---|---|---|---|
| 33 | 0 | 5.0 | 0.5 | 66.1 | 91.6 | 93.1 | 71.0 | 78.8 |
| 34 | 1.0 | 5.0 | 0.5 | 64.5 | 93.7 | 93.1 | 49.4 | 74.1 |
| 35 | 0 | 10.0 | 1.0 | 63.0 | 86.1 | 92.4 | 59.6 | 76.1 |
| 36 | 1.0 | 10.0 | 1.0 | 67.4 | 91.2 | 93.1 | 79.0 | 85.2 |
| 37 | 0 | 15.0 | 1.5 | 61.1 | 83.8 | 94.6 | 74.8 | 85.1 |
| 38 | 1.0 | 15.0 | 1.5 | 65.4 | 86.2 | 96.9 | 58.6 | 75.1 |

(1)Dow High Molecular Weight, High Charge Density Anionic Polyacrylamide - XD - 30057.03.
(2)Paper Contains No Cationic Flocculant nor Latex.
(3)lb/in at 55 lb B.W./1000 $ft^2$.

As indicated in the above table the ketene dimer provides excellent sizing and paper bond performance, compared to the succinic acid anhydride.

Examples 33–38, the data for which are shown in Table IV above, demonstrate the advantages to be obtained by the use of STA-LOK 500 cationic potato starch as a binder when used together with an anionic polymer as a retention aid. The handsheets prepared in Examples 33–38 used in this study were prepared in a manner similar to that of Procedure A, except that saturated calcium carbonate ($CaCO_3$) water was used to make the handsheets within the sheet mold as dilution. The results show that cationic starch binder provides excellent retention of the filler and that improvement in filler retention and porosity is provided by the anionic polymer.

The examples above resulted in the preparation of handsheets by laboratory methods. Consequently a buffer such as calcium carbonate was not added. However, in a full scale paper-making operation, a buffer such as calcium carbonate must be added to the calcium sulfate-filled furnish because the calcium sulfate tends to buffer the system to a lower pH. This is not a problem in the laboratory where there is no build up in acidity from the lab furnish, and consequently no buffers were used in the laboratory experiments. However, on a paper-making machine which engages in a large amount of recirculation of water which is drained from the furnish in making the sheet, continual input of acidic paper stock causes a build up of acidity in the system which must be buffered to maintain neutral to slightly alkaline conditions in order to insure that the strength of the sheet will be optimum.

EXAMPLE 39

A commercial run is carried out in the plant to produce a calcium sulfate dihydrate paper for conversion to marketable gypsum board. The paper line is first set up to make conventional paper utilizing 100% conventional paper stock. After the line is running, the process is converted to making calcium sulfate paper by adding a cationic flocculant, finely ground calcium sulfate dihydrate filler and calcium carbonate buffer to the filler refiner dump chest. Latex binder is added to the filler machine chest followed by addition of anionic polyacrylamide retention aid to the dilute machine furnish after the fan pumps.

The initial paper is comprised of succinic acid anhydride internally sized regular furnish manila paper which is the cover sheet which faces outward when the gypsum board is attached to the wall frame. The change over to calcium sulfate furnish is accomplished by adding calcium sulfate landplaster and latex to the filler portion of the sheet at twice the steady state rate and the cationic flocculant, and anionic retention aid at the steady state rate. Water is added to the topliner and dilute aqueous silicone emulsion is added to the bondliner in the wet calender stack after the dryers. The silicone emulsion contains 1% alum solids. Internal sizing levels are adjusted to provide sufficient moisture pickup, 2.5%, in the calender stack. Internal sizing levels applied to the various plies are 3, 8, 5, and 9 lb/ply ton of succinic acid anhydride cationized with 2.0 lb cationic starch/lb of size utilized respectively in the two bondliner plies, the filler ply beneath the topliner and the two topliner plies. The bondliner of the filler portion of the sheet is the part in contact with the gypsum core of the board. The topliner is the portion of the sheet facing outwardly. The bondliner internal and surface sizing levels are set to provide uniform resistance to excessive wetting of the sheet in board manufacture. The topliner internal sizing is set to obtain adequate decorating properties of the dried board.

Steady state proportions in the filler stock portion of the sheet are achieved as given below following conversion to calcium sulfate dihydrate filled paper:

| | | |
|---|---|---|
| Fiber: | Kraft Cuttings | 56% |
| | Waste News | 14% |
| Fillers: | Calcium Sulfate (Dihydrate) | 22–25% |
| | Calcium Carbonate (Buffer) | 2–5% |
| Chemicals: | Styrene-Butadiene Latex | 3% |
| | Cationic Polyacrylamide Flocculant | 2–4 lb/ton |
| | Anionic Polyacrylamide Retention Aid | 0.5–1.50 lb/ton |
| | Silicone Surface Size Solids | 0.35–0.50 lb/ton |

The manila topliner comprising 25% of the total manila sheet consists of flyleaf or magazine trimmings.

Following manufacture of filled manila, newslined, the covering paper which faces toward the house frame is made using above filled-paper stock proportions throughout all of the sheet. Sizing levels of succinic acid anhydride employed are 4, 8, 8 and 9 lb/ply ton in the bondliner plies and the two top plies respectively, where the bondliner is the portion of the sheet against the gypsum core.

The papers so formed as above are more porous and give up moisture by drainage and drying more readily than conventional gypsum board cover sheets. These properties provide substantial drying steam energy savings of 27%. The papers formed above are then used to produce gypsum wallboard in the conventional manner, as described in Procedure B above. The more open porosity of the filled-paper compared to conventional paper provides a 5% board drying energy savings due to easier drying. The converted board demonstrates excellent paper-to-core bond, transverse strengths and decorating characteristics.

The following are the desired ranges for the various constituents utilized:

| | |
|---|---|
| Fiber Freeness | |
| Range: | 300–550 ml. CSF |
| Optimum: | 350 ml. CSF |
| Filler, as Calcium Sulfate or Calcium Carbonate | |
| Range: | 10–35 dry weight % |
| Binder, as Latex or Cationic Starch | |
| Range: | 1–3% |
| Ratio: | 1% Binder/10% Filler |
| Cationic Flocculant, with Latex Only | |
| Range: | 2–4 lb/ton or 0.1–0.2% |
| Buffer for Calcium Sulfate - Filled Furnish | |
| As either $CaCO_3$ or $Na_2CO_33$ | |
| Range: | 0.25–10% |
| Sizing Agent | |
| As either Ketene Dimer or Succinic Acid Anhydride Compound | |
| Range: | 3–7 lb/ton or 0.15–0.35% |
| Retention Aids | |
| Cationic Starch: | 10–14 lb/ton or 0.5–0.7% |
| Anionic or Cationic Polymers: | 0.5–1.5 lb/ton or 0.025–0.075% |

The composite paper of the present invention utilizing calcium sulfate as a filler has several advantages when utilized as paper cover sheets for making gypsum wallboard over other papers conventionally used which do not have a mineral filler. First, it is more porous than conventional papers. Consequently, in the fabrication of the paper, the water utilized drains off more rapidly so that the amount of heat energy required for drying the paper is about 27% less than that required for drying conventional paper. Furthermore, the porous structure of the sheet provides faster drying, higher machine speeds and greater production with existing papermill equipment. Further, when the paper is utilized in the fabrication of gypsum wallboard, because it is porous, about 5% less heat energy is required in drying and setting the wallboard then is required for use with conventional paper cover sheets. Additionally, because of the selected ratios of filler to paper fibers, and because of the binders and binder ratios utilized, the paper has excellent physical properties. Further, in the improved embodiment, utilizing an additional surface size on the side of the paper which engages the gypsum core results in considerably improved bond between the paper and the gypsum core even when subjected to elevated temperature and humidity. Additionally, from an economic standpoint, the use of plentiful and inexpensive gypsum as a filler leads to substantial material economies. Further, the presence of gypsum in the paper leads to excellent adhesion between the paper and the gypsum core of the final gypsum board.

Additional advantages accrue from the use of an internal neutral or slightly alkaline size which results in a paper sheet which is stronger than that made with an acid size such as rosin and alum. Consequently, a sheet of comparable strength to that of the conventional rosin-alum sized sheet may be obtained while using less cellulose fibers. This results in a thinner sheet which drains more readily and more rapidly, and requires less heat for drying, resulting in substantial fuel savings. Alternatively, weaker and less expensive fiber may be utilized, since neutral size does not weaken the fibers. When an acid size such as rosin and alum is used the fibers are materially weakened. An alum and rosin sized sheet is acid by nature due to the addition of the alum. Being acid, the fibers which make up the sheet are stiff and generally tubular and non-conformable. As a result, the bonding provided by these fibers is poorer than that which may be obtained with a more conformable fiber. In contrast, paper which is made with neutral size consists of fibers which are conformable. They assume a flatter position more readily than fibers which are subjected to acid. As a result they provide better bonding and better strength. Consequently, as stated, the improved strength properties of the sheet imparted by the neutral sized fibers can be utilized to reduce the basis weight of the sheet, that is, the amount of materials utilized, and/or to reduce the amount of hard stock used to maintain the strength of the sheet. Other advantages obtained through the use of neutral size are reduced corrosion on the paper machine and a generally cleaner system than an alum and rosin system.

Additionally through the use of a surface size, improved uniformity of internal sizing is obtained. Because of this, the amount of the internal size application may be reduced, while still obtaining good results. Moreover, when manila paper is used, a significant increase in the soft stock content may be utilized. This is made possible by the improved strength of the sheet under like conditions when neutral size is used. The same advantages are obtained when using other papers.

A further advantage has been observed. When paper machines formed of non-corrosion-resistant metal parts are used, such as those made of steel and iron, corrosion is greatly reduced. This result is obtained because the system utilizing neutral size is maintained at a pH of about 7.0–7.8. Consequently the ferrous metal parts are not attacked. On the other hand, the pH conditions of 4.5–5.0, as experienced in the use of an alum and rosin size, cause corrosion of unprotected non-corrosion-resistant metals.

The large reduction or elimination of both alum and rosin size results in a stock system which is a lot cleaner ionically and chemically. This means that fewer problems are encountered with chemical buildup which causes variations in paper quality and excessive filling of the paper machine cylinder wires. Additionally fouling of carrying felts results in a high frequency of shutdowns for cleaning. The use of neutral size also greatly reduces the conditions of high chemical buildup in the system, which may contribute to the above difficulties.

The cationic starch of the invention has several functions. First, it acts as an emulsifying medium in which the size particles are dispersed. Second, it serves to coat the individual particles of size to protect them from hydrolysis. Third, the cationic starch imparts a positive charge to the individual size particles causing them to remain separated from each other. Fourth, the cationic starch serves to attach the size particles electrostatically to individual cellulose fibers. Fifth, the cationic starch acts as a retention aid or binder for the size particles and maintains them affixed to the cellulose fibers. Sixth, the cationic starch enhances the tensile strength of the final paper by improving the fiber-to-fiber bond. Finally, the cationic starch acts as a retention aid to retain the buffer particles, such as calcium carbonate, to the paper fibers.

The buffering agent is utilized to maintain the internal neutral size at a pH of at least 7 and preferably 7 to 7.8. This prevents acid conditions from occurring which would be detrimental to fiber strength. If the acidity of the furnish in the system is not neutralized by the presence of the buffer, the system becomes acid from the acidity in the waste paper furnish and the benefits of the neutral size such as high sheet strength and reduced furnish cost can not be achieved.

The surface size utilized on the surface of the bond liner prevents migration of starch out of the gypsum core and contributes towards better bond between the paper and the core. Suitable surface size materials are silicone resins. Their efficiency may be enhanced by the addition of an acid material to the silicone resin prior to application which assists in the polymerization of the silicone resin. Suitable acidic materials are alum and boric acid.

The neutral or slightly alkaline sizing agents of the present invention may be of two kinds. The first type are the substituted cyclic dicarboxylic acid anhydrides corresponding to the following structural formula:

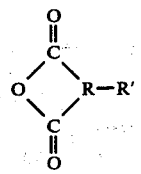

wherein R represents a dimethylene or trimethylene radical and wherein R' is a hydrophobic group containing more than 5 carbon atoms which may be selected from the group consisting of alkyl, alkenyl, aralkyl or aralkenyl groups. Substituted cyclic dicarboxylic acid anhydrides falling within the structural formula above are the substituted succinic and glutaric acid anhydrides.

Specific examples of the above described sizing agents include iso-octadecenyl succinic acid anhydride, n-hexadecenyl succinic acid anhydride, dodecenyl succinic acid anhydride, dodecyl succinic acid anhydride, decenyl succinic acid anhydride, octenyl succinic acid anhydride, nonenyl succinic acid anhydride, triisobutenyl succinic acid anhydride, capryloxy succinic acid anhydride, heptyl glutaric acid anhydride, and benzyloxy succinic acid anhydride. It has been found that optimum results are obtained with acid anhydrides in which R' contains more than twelve carbon atoms. In addition to the above individual compounds, mixtures of these compounds may also be employed.

Among the preferred neutral sizing compositions are Accosize 18 and Fibran 68. Accosize 18 is a trademarked product of American Cyanamid Company and is a substituted succinic acid anhydride having a total of from 15 to 20 carbon atoms, and contains about 1% of an anionic surfactant. Fibran 68 is a trademarked product of National Starch and Chemical Corporation and is a substituted succinic acid anhydride having a total of 15–20 carbon atoms. Fibran 68 normally does not contain any emulsifying agent. However, it is advantageous to add such an agent to promote the emulsification of the product. The amount of sizing agent employed may range from about 0.15% to about 0.35% of the dry weight of the finished paper. Larger amounts may be used without adverse effects, but the excess adds little to the sizing properties.

Other useful neutral or alkaline sizing agents for use in the present invention are ketene dimers, the structural formula of which has been set out above. Among the useful materials are Hercon 32 and Hercon 40 marketed by the Hercules Company.

In those examples where it is used, the cationic retention agent is useful in promoting or aiding the retention of the sizing agents and for bringing the agents into close proximity to the pulp fibers. Although any of a large number of cationic agents may be utilized in the invention, such as alum, aluminum chloride, long chain fatty amines, sodium aluminate, thermosetting resins and polyamide polymers, the preferred cationic agents are the various cationic starch derivatives including primary, secondary, tertiary or quarternary amine starch derivatives. Such derivatives are prepared from all types of starches including corn, tapioca, potato, waxy maize, wheat and rice. The cationic starch agent may be used in an amount by weight of from about 0.5% to about 0.7% based on the dry weight of the paper. A preferred cationic starch is STA-LOK 500 manufactured by the A. E. Staley Manufacturing Company.

The buffer material may be any of a number of compounds which are salts of a cation of a strong base and an anion of a weak acid. Although a number of materials may be utilized such as sodium carbonate and sodium bicarbonate, the preferred buffering agent is calcium carbonate. This material is instrumental in maintaining the pH of the sizing agent and paper in a range of from about 7 to about 7.3. Additionally, the $CaCO_3$ buffer as filler improves sheet porosity and improves drainage rate, thereby facilitating the drying of the paper and reducing the amount of energy necessary to manufacture the paper and the resultant gypsum wallboard. An amount of at least 2% should be utilized. An amount greater than about 6% is no longer functional as a buffer, but larger amounts up to 10% and greater may be used where the calcium carbonate serves as both a buffer and a filler.

It has been found advantageous to provide a surface coating on the bond liner of the paper, that is, the surface of the paper which becomes affixed to the gypsum core of the wallboard. A preferred material is an epoxy resin such as a silicone emulsion RE-30 a trademarked material marketed by Union Carbide Corporation. Additionally, a silicone emulsion, Tego 5342A, a trademarked material manufactured and marketed by the Goldschmidt Chemical Corporation is suitable. Further, it has been found that even though the use of an acid material to facilitate setting or curing of a sizing agent is detrimental when used as an internal sizing agent, the use of an acid material such as alum or boric acid with the epoxy sizing agent as a surface size facilitates the cure of the epoxy resin, and, because it does not enter internally into the paper, does not adversely affect the strength of the paper fibers.

As stated, in order to achieve the required quality performance of neutral-size paper utilized to fabricate gypsum wallboard, the addition of a weak acid material such as alum to the dilute silicone emulsion in the concentration of 1% alum solids is critical for achieving optimum performance.

Prior to the use of the present novel application of alum to the external silicone size itself, it was found that neutral-sized paper which was contaminated at discreet points in the surface of the paper with dirt, shives and bark, and which was surface sized with untreated silicone emulsion had a tendency to form mini-cockles (dimples) in the gypsum wallboard. Subsequent field tests showed that the paper in the area of the dimpling was poorly sized internally and had substantial amounts of dirt in it.

When alum-treated silicone was applied to the surface of the paper in manufacture, the dimpling of the board was eliminated. It is believed that the alum-acidified silicone did not strike into the paper in the areas of poor internal sizing, whereas the untreated silicone did strike in. This strike-in defeated the purpose of the silicone which was to give uniform paper sizing to provide a cockle-free board. It is believed that where a surface size strikes into the sheet of paper it is unavailable at the paper surface to provide surface sizing.

Alum-treated silicone size is most effective when applied to the surface of a sheet having a filler of a material such as calcium carbonate which acts as a buffer. When the alum-treated silicone comes in contact with the calcium carbonate, the pH changes from 3.5–4.0 to neutrality. It is believed that this causes the silicone to cure out on the paper surface, thereby providing the desired sizing uniformity. The alum addition appears to have no appreciable adverse effect on the tensile strength of the resulting paper, nor any visible adverse effect on the stability of the silicone emulsion nor on its tendency to polymerize. Whatever curing effect takes place occurs as the silicone is applied to the surface of the unsized, neutral and 5% calcium carbonate filled paper.

It is to be understood that the invention is not to be limited to the exact details of operation or materials described, as obvious modifications and equivalence will be apparent to one skilled in the art.

What is claimed is:

1. Gypsum wallboard comprising a core of set calcium sulfate dihydrate and a paper cover sheet bonded to each surface thereof, each of said paper cover sheets comprising:

(A) a major proportion of cellulose fibers, (B) calcium sulfate as a filler in an amount of from about 10% to about 35% in dry weight, (C) a binder in an amount from about 1% to about 3½%, (D) a neutral sizing agent in an effective amount to prevent water penetration, (E) a buffering agent comprising a salt of a cation of a strong base and an anion of a weak acid in an amount from about 0.25% to about 10%, and (F) an anionic retention aid in an amount suitable for retaining said filler in said paper.

2. Gypsum wallboard according to claim 1, wherein said filler is calcium sulfate dihydrate.

3. Gypsum wallboard according to claim 2, wherein said retention aid is an anionic polymer.

4. Gypsum wallboard according to claim 3, wherein said anionic polymer is an anionic polyacrylamide.

5. Gypsum wallboard according to claim 3, wherein said neutral sizing agent is a cyclic dicarboxylic acid anhydride applied as an internal sizing agent having the structural formula:

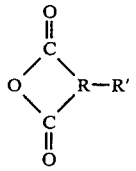

wherein R is selected from the group consisting of dimethylene and trimethylene radicals, and wherein R′ is a hydrophobic group containing more than 5 carbon atoms selected from the group consisting of alkyl, alkenyl, aralkyl and aralkenyl groups.

6. Gypsum wallboard according to claim 5, wherein said cyclic dicarboxylic acid anhydride is a substituted succinic acid anhydride having a total of 15 to 20 carbon atoms.

7. Gypsum wallboard according to claim 5, wherein said substituted succinic acid anhydride is present in an amount of from about 0.15% to about 0.35% by dry weight.

8. Gypsum wallboard according to claim 5, wherein an emulsifying agent is added to said cyclic dicarboxylic acid anhydride.

9. Gypsum wallboard according to claim 2, wherein said neutral sizing agent has the following structural formula:

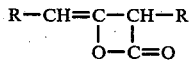

wherein each R has 8–18 carbon atoms.

10. Gypsum wallboard according to claim 9, additionally containing a cationic polymer.

11. Gypsum wallboard according to claim 2, wherein said buffer is calcium carbonate.

12. Gypsum wallboard according to claim 11, wherein said calcium carbonate is present in an amount of from about 2% to about 10% by dry weight.

13. Gypsum wallboard according to claim 2, wherein a surface size coating comprising a silicone resin is applied to at least the surface of the bondliner of said paper.

14. Gypsum wallboard according to claim 13, wherein said surface size also includes an acidic agent in an amount suitable for promoting the polymerization of said silicone resin.

15. Gypsum wallboard according to claim 14, wherein said acidic agent is alum.

16. Gypsum wallboard according to claim 15, wherein said silicone resin is present in an amount of from about 0.015% to about 0.025%, and said alum is present in an amount of about 2½ times the dry weight of said silicone resin.

17. Gypsum wallboard according to claim 13, wherein said silicone resin is a dimethyl polysiloxane resin.

18. Gypsum wallboard comprising a core of set calcium sulfate dihydrate and a paper cover sheet bonded to each surface thereof, each of said paper cover sheets comprising a composite paper which comprises in dry weight percent:

(A) cellulosic fibers in an amount of from about 65% to about 90% and having a fiber freeness of from about 300 ml to 550 ml Canadian Standard Freeness, (B) a particulate mineral filler in an amount of from about 10% to about 35%, (C) a binder in an effective amount to retain said mineral filler, (D) a neutral sizing agent in an effective amount to prevent water penetration, and (E) an anionic polymer as a retention aid for said mineral filler, said paper being sufficiently porous to permit good drainage and rapid drying during its production, and when applied to the surfaces of a gypsum slurry for forming wallboard, permits less heat to be utilized in the wallboard conversion, the use of said paper thereby conserving energy both in paper production and in the board production.

19. Gypsum wallboard according to claim 18, wherein said binder is cationic potato starch.

20. Gypsum wallboard according to claim 18, wherein said mineral filler is calcium carbonate.

21. Gypsum wallboard according to claim 19, wherein said mineral filler is present in an amount of from about 25% to about 30% in dry weight.

22. Gypsum wallboard according to claim 19, wherein said retention aid is an anionic polyacrylamide.

23. Gypsum wallboard comprising a core of set calcium sulfate dihydrate and a paper cover sheet bonded to each surface thereof, each of said paper cover sheets comprising a composite paper which comprises in dry weight percent:

(A) fibers in an amount of from about 65% to about 90% and having a fiber freeness of from about 300 ml to 550 ml Canadian Standard Freeness, (B) a particulate mineral filler in an amount of from about 10% to about 35%, (C) a binder in an effective amount to retain said mineral filler, (D) a cationic flocculant in an amount of from about 0.1% to about 0.2%, and (E) a neutral sizing agent in an effective amount to prevent water penetration, and having the following structural formula:

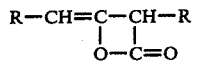

wherein each radical R has from 8 to 18 carbon atoms.

24. Gypsum board according to claim 23, wherein said mineral filler is calcium carbonate.

25. Gypsum board according to claim 24, wherein said binder is a cationic starch.

26. Gypsum wallboard according to claim 1, additionally comprising a cationic flocculant in an amount of from about 0.1% to about 0.2%.

27. Gypsum wallboard according to claim 18, additionally comprising a cationic flocculant in an amount of from about 0.1% to about 0.2%.

28. Gypsum wallboard according to claim 23, additionally comprising an anionic retention aid in an amount suitable for retaining said filler in said paper.

* * * * *